US011120938B2

(12) United States Patent
Portuondo Bautista et al.

(10) Patent No.: US 11,120,938 B2
(45) Date of Patent: Sep. 14, 2021

(54) CURRENT TRANSFORMER APPARATUS THAT IS MOUNTABLE TO A CIRCUIT BOARD

(71) Applicant: EATON INTELLIGENT POWER LIMITED, Dublin (IE)

(72) Inventors: Laura Teresa Portuondo Bautista, Los Rios (DO); Glennys Johanny Jesús Reyes, San Cristobal (DO)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/009,180

(22) Filed: Sep. 1, 2020

(65) Prior Publication Data

US 2020/0395169 A1 Dec. 17, 2020

Related U.S. Application Data

(63) Continuation of application No. 15/083,478, filed on Mar. 29, 2016, now abandoned.

(51) Int. Cl.

| | |
|---|---|
| ***H01F 27/29*** | (2006.01) |
| ***H01F 27/06*** | (2006.01) |
| ***H01F 27/28*** | (2006.01) |
| ***H01F 38/28*** | (2006.01) |

(52) U.S. Cl.

CPC ..... *H01F 27/29* (2013.01); *H01F 27/06* (2013.01); *H01F 27/2823* (2013.01); *H01F 38/28* (2013.01); *H01F 2027/065* (2013.01)

(58) Field of Classification Search

CPC ..... H01F 27/29; H01F 27/06; H01F 27/2823

See application file for complete search history.

(56) References Cited

U.S. PATENT DOCUMENTS

| | | | | | |
|---|---|---|---|---|---|
| 3,140,907 | A * | 7/1964 | Davies | H01R 13/26 | 439/59 |
| 3,172,718 | A * | 3/1965 | Lalonde | H01R 12/585 | 439/634 |
| 3,436,709 | A * | 4/1969 | Berkelhamer | H01F 29/06 | 336/192 |
| 3,479,634 | A * | 11/1969 | Pritulsky | H01R 12/728 | 439/560 |
| 3,486,163 | A * | 12/1969 | Dereymaeker | H01R 12/721 | 439/249 |
| 3,764,955 | A * | 10/1973 | Ward | H01R 12/716 | 439/377 |

(Continued)

*Primary Examiner* — Elvin G Enad
*Assistant Examiner* — Malcolm Barnes
(74) *Attorney, Agent, or Firm* — Eckert Seamans Cherin & Mellott, LLC

(57) ABSTRACT

A current transformer apparatus is configured to enable it to be electrically connected with and physically mounted to a circuit board. The current transformer apparatus includes a support upon which a coil is situated and upon which a plurality of approximately U-shaped electrical connectors are also situated. The electrical connectors each include an electrical contact that is biased toward a reaction structure. A circuit board is received between the electrical contact and the reaction structure, and the bias between the electrical contact and the reaction structure mounts current transformer apparatus to the circuit board and provides an electrical connection therebetween.

20 Claims, 7 Drawing Sheets

(56) References Cited

U.S. PATENT DOCUMENTS 4,263,479 A * 4/1981 Lange ..... H01F 17/062 178/46
4,558,912 A * 12/1985 Coller ..... H01R 12/716 439/246
4,652,975 A * 3/1987 Scott ..... H01F 27/06 336/65
4,821,152 A * 4/1989 Lorenzen ..... H01F 27/027 174/138 G
4,855,866 A * 8/1989 Imamura ..... H01G 4/35 361/306.2
5,049,511 A * 9/1991 Yu ..... H01R 12/83 439/325
5,238,411 A * 8/1993 Jinno ..... H01R 12/721 439/59
6,476,703 B2 * 11/2002 Geltsch ..... F16K 31/0679 335/208
6,688,892 B2 * 2/2004 Fukumoto ..... H01R 13/04 439/65
6,753,749 B1 * 6/2004 Chin ..... H01F 27/027 336/83
7,255,586 B2 * 8/2007 Okada ..... H01R 13/20 439/346
7,289,012 B2 * 10/2007 Tran-Ngoc ..... H01F 5/04 336/90
7,902,954 B2 * 3/2011 Bamber ..... H01F 7/06 336/208
8,672,718 B2 * 3/2014 Suzuki ..... H05K 1/117 439/876
2001/0008044 A1 * 7/2001 Machado ..... H01F 27/027 29/840
2002/0047616 A1 * 4/2002 Yamaguchi ..... H05B 41/042 315/276
2007/0085646 A1 * 4/2007 Bilyeu ..... H01Q 1/3241 336/65
2009/0215317 A1 * 8/2009 Idzik ..... H01R 4/02 439/629
2010/0201472 A1 * 8/2010 Le ..... H01F 27/02 336/96

* cited by examiner

CURRENT TRANSFORMER APPARATUS THAT IS MOUNTABLE TO A CIRCUIT BOARD

CROSS REFERENCE TO RELATED APPLICATION

This application is a continuation application of and claims priority to U.S. patent application Ser. No. 15/083,478, filed Mar. 29, 2016, the disclosures of which are incorporated herein by reference.

BACKGROUND

Field

The disclosed and claimed concept relates generally to electronic equipment and, more particularly, to a current transformer apparatus that is electrically connectable with and mountable to a circuit board such as a printed circuit board.

Related Art

Numerous types of electronic equipment are known in the relevant art. One type of electronic component is a current transformer which includes a length of wire that is wound into a coil to form a winding. The wire typically is relatively thin, and the ends of the wire are typically soldered to pins that are mounted on a circuit board. While such current transformers have been generally effective for their intended purposes, they have not been without limitation.

The soldered connections between the end of the wire and the pins that are mounted to the circuit board have been difficult to make due to the thinness of the wire and the difficulty in handling the wire, and for other reasons. Also, the soldered connections between the ends of the wire and the pins that are mounted to the circuit board have been subject to breakage during movement of the current transformer and circuit board from one location to another and during installation. Improvements thus would be desirable.

SUMMARY

Accordingly, an improved current transformer apparatus is configured to enable it to be electrically connected with and physically mounted to a circuit board. The current transformer apparatus includes a support upon which a coil is situated and upon which a plurality of approximately U-shaped electrical connectors are also situated. The electrical connectors each include an electrical contact that is biased toward a reaction structure, and in the depicted exemplary embodiment the electrical contact and the reaction structure are both a part of the electrical connector. A circuit board is received between the electrical contact and the reaction structure, and the bias between the electrical contact and the reaction structure mounts current transformer apparatus to the circuit board and provides an electrical connection therebetween.

An aspect of the disclosed and claimed concept is to provide an improved current transformer apparatus that is easily mountable on and removable from a circuit board.

Another aspect of the disclosed and claimed concept is to provide such an improved current transformer apparatus that avoids the need to provide soldered electrical connections between the ends of the wire of an electrical winding and pins that have been mounted to a circuit board.

Accordingly, an aspect of the disclosed and claimed concept is to provide an improved current transformer apparatus that is structured to be electrically connected with and to be mounted to a circuit board. The current transformer apparatus can be generally stated as including a coil apparatus comprising a wire that is wound into a coil, a support, the coil apparatus being situated on the support, a connection apparatus that can be generally stated as including a plurality of electrical contacts and a number of reaction structures situated on the support, the plurality of electrical contacts can be generally stated as including a pair of electrical contacts, an electrical contact of the pair of electrical contacts having an electrical connection with the wire, another electrical contact of the pair of electrical contacts having another electrical connection with the wire, at least one of the at least first reaction structure and the plurality of electrical contacts being biased generally toward the other of the at least first reaction structure and the plurality of electrical contacts and being structured to engage the circuit board between the plurality of electrical contacts and the at least first reaction structure to mount the current transformer apparatus to the circuit board.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

An improved current transformer apparatus 4 in accordance with a first embodiment of the disclosed and claimed concept is depicted generally in FIGS. 1-5. The current transformer apparatus 4 includes a coil apparatus 6, and it further includes a support 10 upon which the coil apparatus 6 is situated. The current transformer apparatus 4 additionally includes a connection apparatus 12 that is likewise situated on the support 10.

Figure 1:
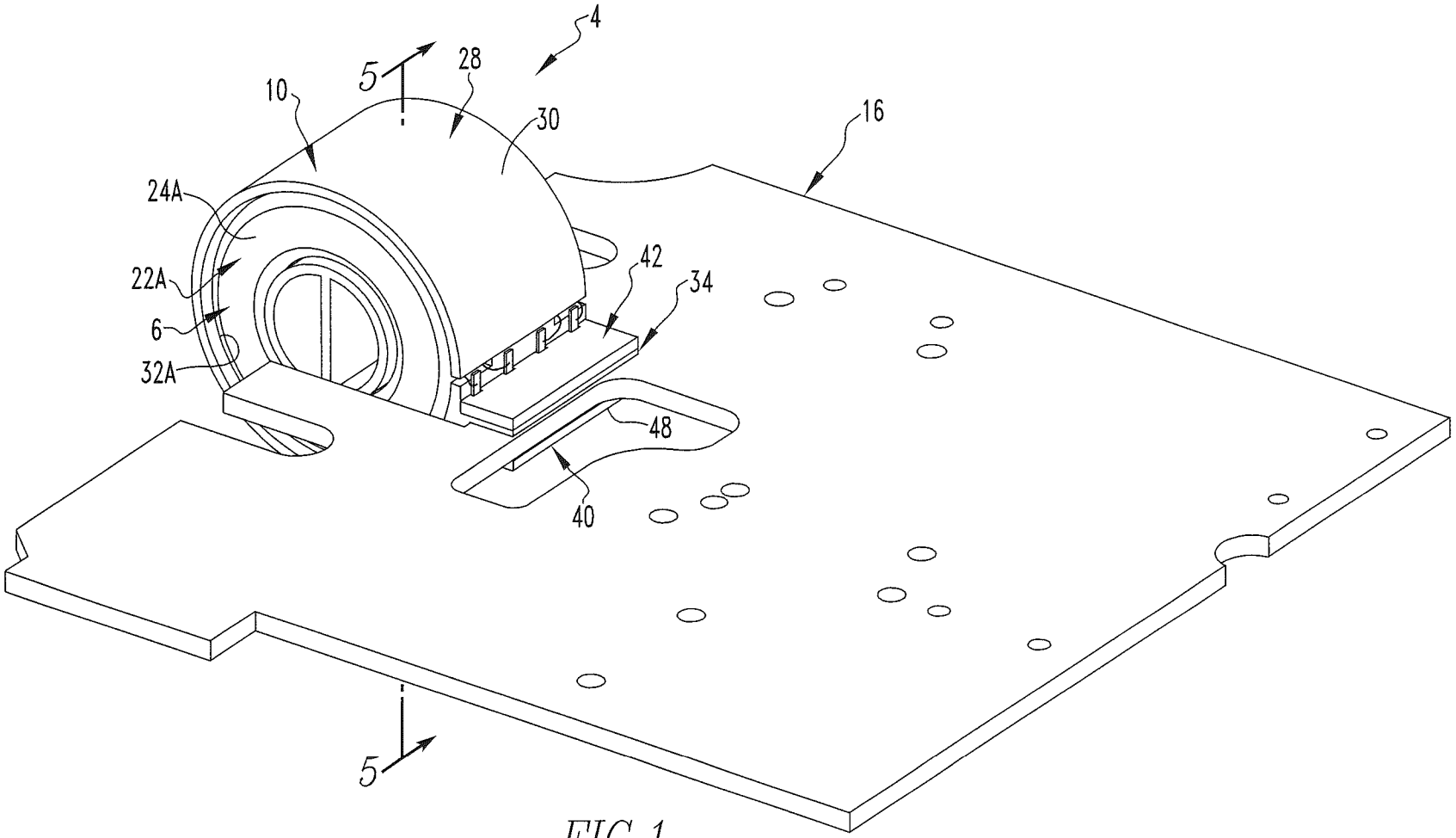
FIG. 1 is a perspective view of an improved current transformer apparatus in accordance with a first embodiment of the disclosed and claimed concept that is mounted to a circuit board.
Figure 2:
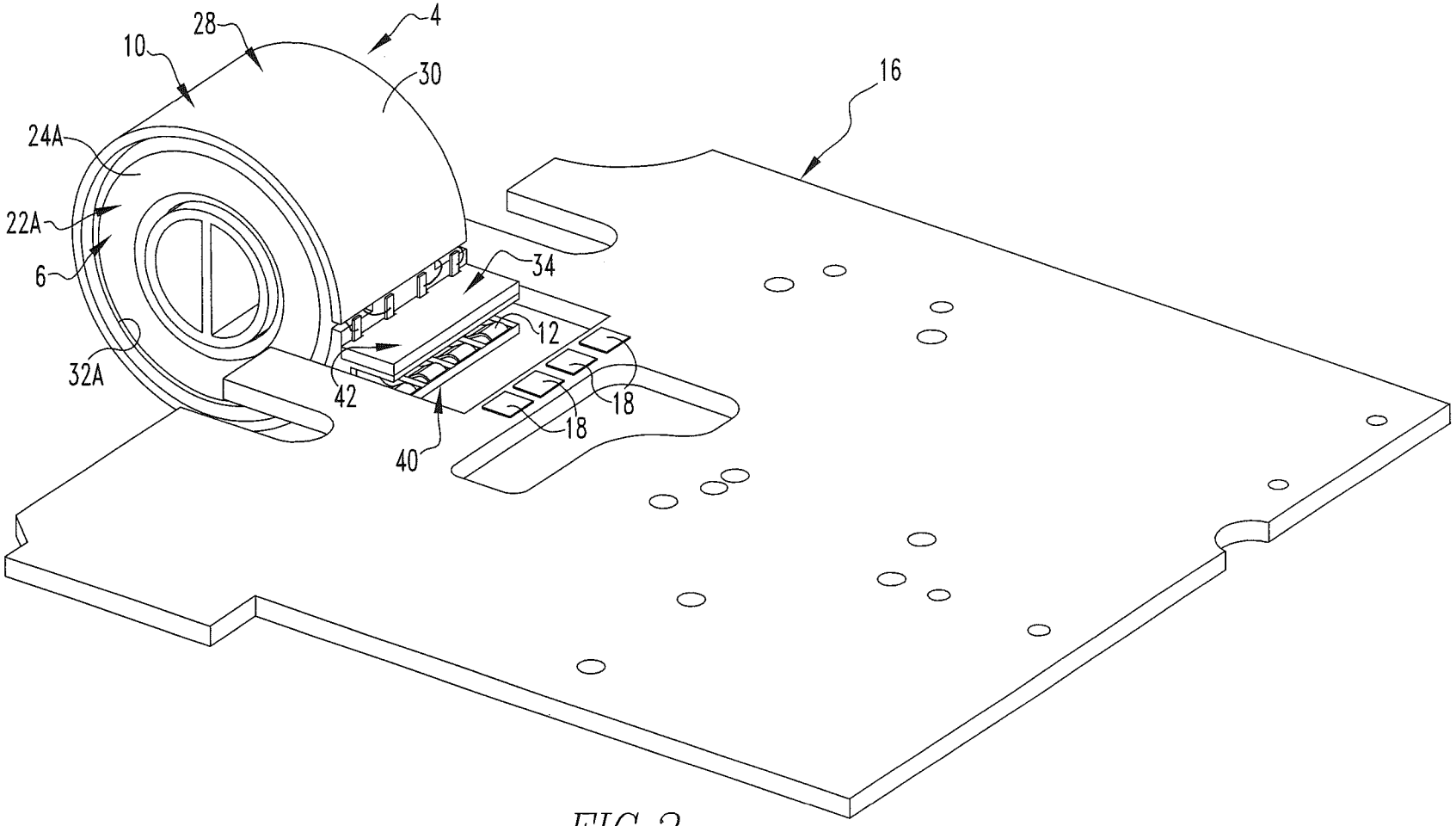
FIG. 2 is a view similar to FIG. 1, except depicting the current transformer apparatus being exploded away from the circuit board.

The current transformer apparatus 4 is advantageously configured to enable it to be mounted onto a circuit board 16, i.e., physically and directly situated on the circuit board 16 such as is depicted in FIG. 1, and to be simultaneously electrically connected with the circuit board 16. The circuit board 16 includes a number of electrically conductive pads 18 that are depicted generally in FIG. 2 and which are electrically connected with various conductors and components that are situated on the circuit board 16 or elsewhere and which enable analysis of signals that are detected from the coil apparatus 6. As employed herein, the expression "a number of" and variations thereof shall refer broadly to any non-zero quantity, including a quantity of one. As will be set forth in greater detail below, the connection apparatus 12 is electrically connectable with the pads 18 to enable the current transformer apparatus 4 to be electrically connected with the circuit board 16.

The coil apparatus 6 includes a pair of coils 22A and 22B that each include a length of wire 24A and 24B, respectively, each having a pair of opposite ends 38. The wires 24A and 24B are each wound in an approximately cylindrical shape to form the windings that can be said to make up the coils 22A and 22B.

The support 10 can be said to include a housing 28 that includes an approximately annular wall 30 that surrounds a pair of sockets 32A and 32B within which the coils 22A and 22B, respectively, are received. The housing 28 further includes a base 34 that is situated on the wall 30. The wall 30 has a pair of openings 36A and 36B formed therein adjacent the base 34 through which the ends 38 of the wires 24A and 24B extend for connection with the connection apparatus 12. The exemplary openings 36A and 36B are in the form of elongated slots but can be of other shapes without departing from the spirit of the present concept.

Figure 3:
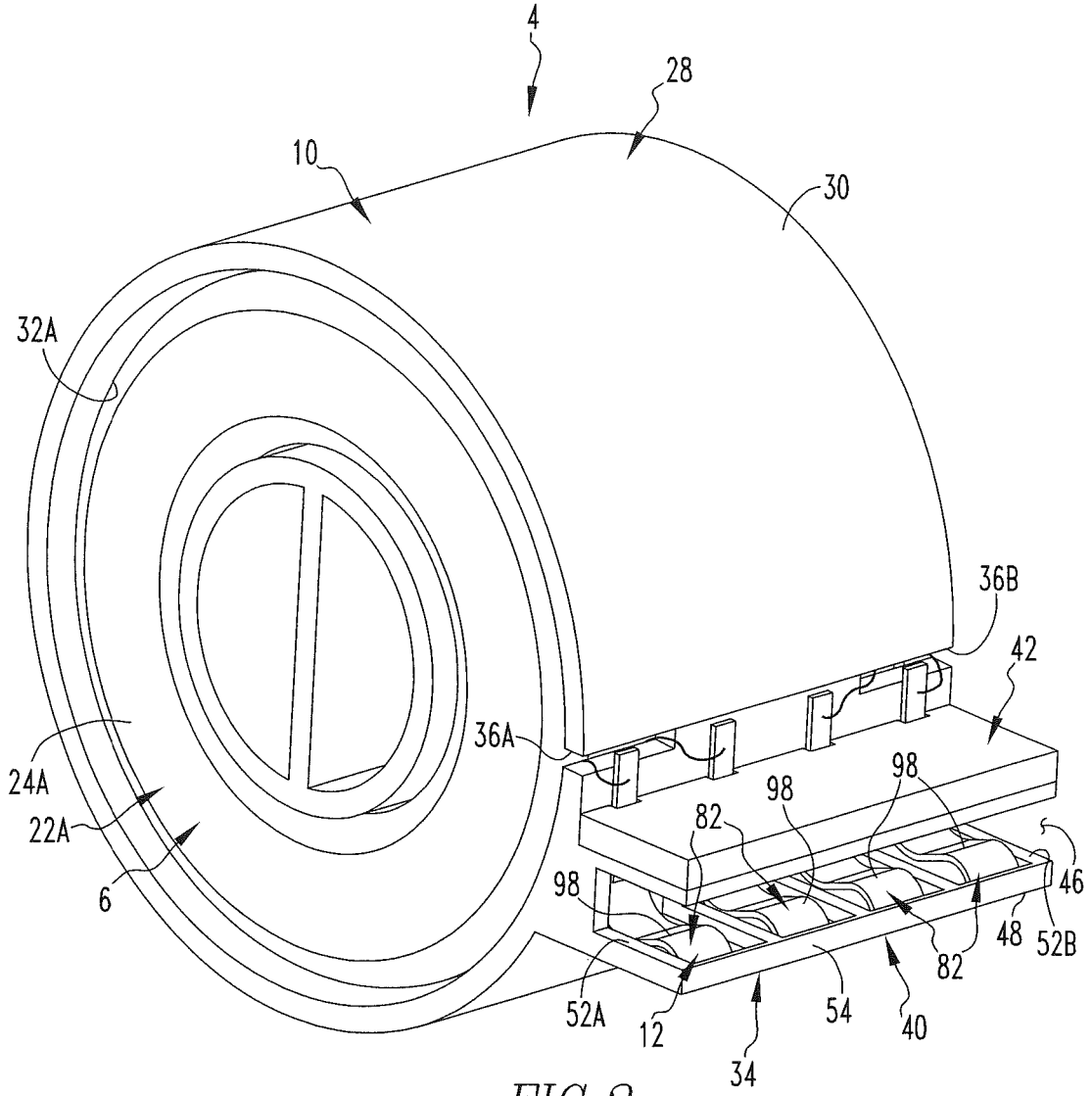
FIG. 3 is an enlarged perspective view of the current transformer apparatus of FIGS. 1 and 2.
Figure 4:
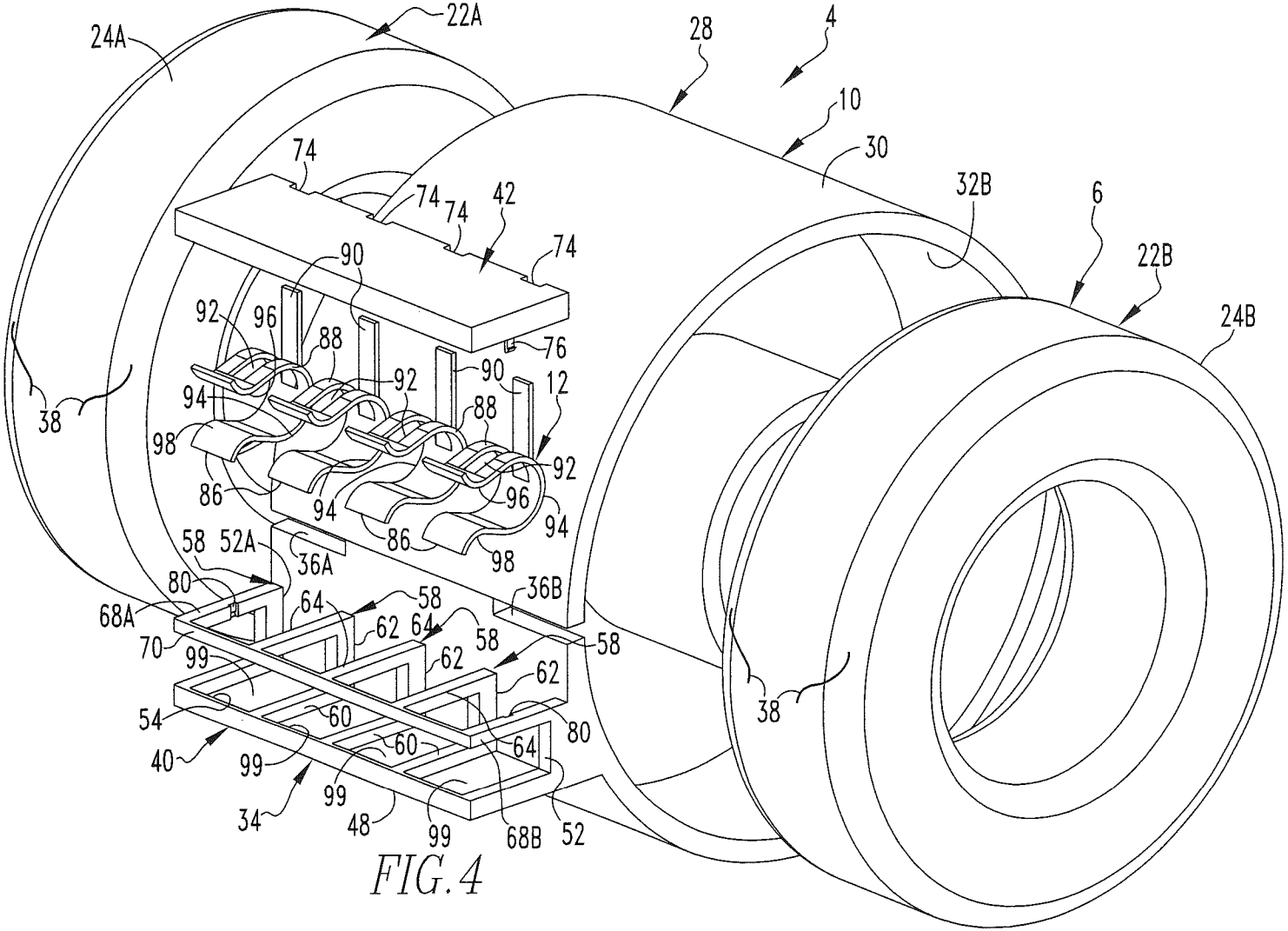
FIG. 4 is an exploded view of the current transformer apparatus of FIG. 3.
Figure 5:
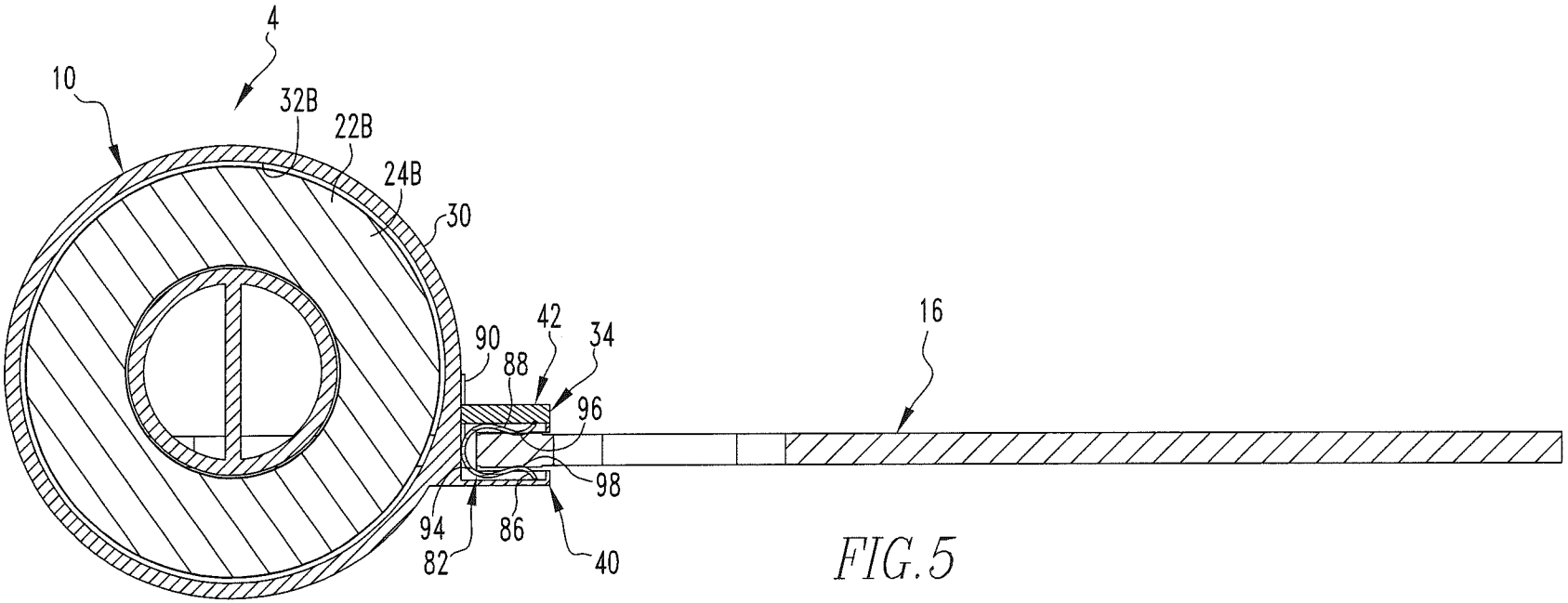
FIG. 5 is a sectional view as taken along line 5-5 of FIG. 1.

As can be understood from FIGS. 3 and 4, the base 34 can be said to include a platform 40 that is situated on the wall 30 and to further include a covering wall 42 that is situated on the platform 40. The platform 40 has an elongated slot 46 formed therein that receives an end of the circuit board 16 in a fashion that will be described in greater detail below.

The platform 40 includes a base wall 48 that is situated opposite the covering wall 42. The platform further includes a pair of lateral abutments 52A and 52B that are approximately L-shaped and which have a portion that extends along the ends of the base wall 48 and another portion that extends along the wall 30. The platform 40 further includes a frontal abutment 54 that extends between the lateral abutments 52A and 52B along the edge of the base wall 48 that is opposite the wall 30. Furthermore, the platform 40 includes a plurality of dividers 58 that each include a first portion 60 that extends along the base wall 48, a second portion 62 that extends along the wall 30, and a third portion 64 that protrudes from the wall 30 and which extends approximately parallel the corresponding first portion 60. The platform 40 further includes a pair of additional lateral abutments 68A and 68B that protrude from the wall 30 and which extend parallel with the third portions 64. Further, the platform 40 includes an additional frontal abutment 70 that extends along the free ends of the third portions 64 and the free ends of the additional lateral abutments 68A and 68B opposite the wall 30. In the depicted exemplary embodiment, the wall 30 and the platform 40 are co-formed as a single piece unit, such as by molding and the like, from an electrically insulative material such as a polymeric material or other appropriate material. As such, the various components of the platform 40 mentioned above are affixed to one another and are co-formed together as a single component.

As can thus be seen in FIG. 4, the covering wall 42 has a set of notches 74 formed in an edge thereof for receiving parts of the connection apparatus 12 therethrough in a fashion that will be set forth in greater detail below. The covering wall 42 further includes a set of latches 76 at opposite ends thereof that are receivable in a set of seats 80 that are formed in the additional lateral abutments 68A and 68B of the platform 40. The latches 76, when received in the seats 80, affix the covering wall 42 to the platform 40.

As is thus shown in FIG. 4, the connection apparatus 12 includes a plurality of electrical connectors 82 that are each of an approximately U-shaped configuration and which can be said to include a solid leg 86 and a perforated leg 80 that has an elongated void region 92 formed therein. The perforated leg 88 and the solid leg 86 are connected with one another at a junction 94. Each electrical connector 82 further includes an elongated pin 90 that protrudes from the junction 94 and which is formed out of the material that was removed from the void region 92. The electrical connectors 82 are each formed of an electrically conductive and flexible material such as copper or another metal and may have additional plating. The pins 90 are received in the notches 74 and are soldered to the ends 38 of the wires 24A and 24B, with each electrical connector 82 being soldered with a single one of the four ends 38. As such, the wire 24A has a pair of the electrical connectors 28 connected at the opposite ends 38 thereof, and the wire 24B likewise has another pair of the electrical connectors 82 connected with the opposite ends 38 thereof.

Since the electrical connectors 82 are formed of a conductive material, it can be understood that the solid leg 86, the perforated leg 88, and the junction 94 are all electrically conductive. However, the solid leg 86 and the perforated leg 88 in a free state are separated from one another by a distance that is less than the thickness of the circuit board 16, and when the circuit board 16 is received in the slot 46 and between the solid leg 86 and the perforated leg 88, the solid leg 86 and the perforated leg 88 are elastically deflected away from one another and are thus biased toward one another via their connection with one another at the junction 94.

From a mechanical standpoint, it can be understood that the solid leg 86 and the perforated leg 88 each apply a compressive load toward the circuit board 16 when the circuit board 16 is received therebetween. As such, at least one of the solid leg 86 and the perforated leg 88 can be said to form an electrical contact 96 that is electrically connected with the circuit board 16 by becoming electrically connected with one of the pads 18 when the circuit board 16 is received in the slot 46 and is compressively engaged between the solid leg 86 and the perforated leg 88. It is noted that in the depicted exemplary embodiment the electrical contact 96 is at least a portion of the perforated leg 88. In a similar fashion, the electrical connectors 82 can each be said to include a reaction structure 98 that opposes the bias of the electrical contact 96 and which, in the depicted exemplary embodiment, is at least a portion of the solid leg 86. It is noted that, depending upon the configuration of the electrical connectors 82, the platform 40 or the base wall 48 can be said to additionally or alternatively form a part of the reaction structure 98 that opposes the bias of the electrical contact 96. This principle can be understood if the system employed alternative electrical connectors that did not additionally include the solid leg 86 and rather included electrical contacts that were spring biased or otherwise biased in a direction toward the base wall 48. In such a situation, the base wall 48 and other structures of the platform 40 would serve as the reaction structure that is situated to oppose the bias by the aforementioned alternative electrical contacts. In the depicted exemplary embodiment, however, the electrical connectors 82 are generally U-shaped and each include both the electrical contact 96 and the reaction structure 98.

As can be understood from FIGS. 3 and 4, the various aforementioned structures of the platform 40 form thereon a set of receptacles 99, each of which receives therein a corresponding one of the electrical connectors 82. The dividers 58 are situated between adjacent pairs of the electrical connectors 82 and serve to electrically isolate each electrical connector 82 from one another. Additionally, the lateral abutments 52A and 52B, the frontal abutment 54, the additional lateral abutments 68A and 68B, and the additional frontal abutment 70 serve to retain the electrical connectors 82 in a position situated between the covering wall 42 and the base wall 48, meaning that they mechanically engage the electrical connectors 82 and resist movement of the electrical connectors 82 in directions away from the wall 30 and away from the base 34.

By securing the electrical connectors 82 on the base 34, the electrical connectors 82 are generally immovable with respect to the support 10 apart from elastic deformation of the solid leg 86 or the perforated leg 88 or both when the circuit board 16 is received between the solid leg 86 and the perforated leg 88 and is removed therefrom. Such advantageous retention of the electrical connectors 82 on the base 34 correspondingly resists movement of the pins 90 with respect to the wires 24A and 24B, which helps to maintain the integrity of the soldered connection between the pins 90 and the ends 38. Movement of the pins 90 is further resisted by the reception of the pins 90 in the notches 74 and the reception of the latches 76 in the seats 80, which serves to clamp the pins 90 against the wall 30.

As such, the current transformer apparatus 4 can be repeatedly received on the circuit board 16, thereby mounting the current transformer apparatus 4 to the circuit board 16 and providing an electrical connection therebetween, and removed from the circuit board 16 without a meaningful risk of damaging the electrical connection between the ends 38 and the pins 90. The current transformer apparatus 4 thus advantageously can be easily mounted to the circuit board 16 and electrically connected therewith simply by slidingly receiving the circuit board 16 in the slot 46 to thereby electrically connect together the pads 18 with the electrical connectors 82 and thus with the ends of the wires 24A and 24B that form the coils 22A and 22B. The improved current transformer apparatus 4 is thus simple to manufacture and simple to install and remove as needed and is mechanically and electrically reliable. Other advantages will be apparent.

Figure 6:
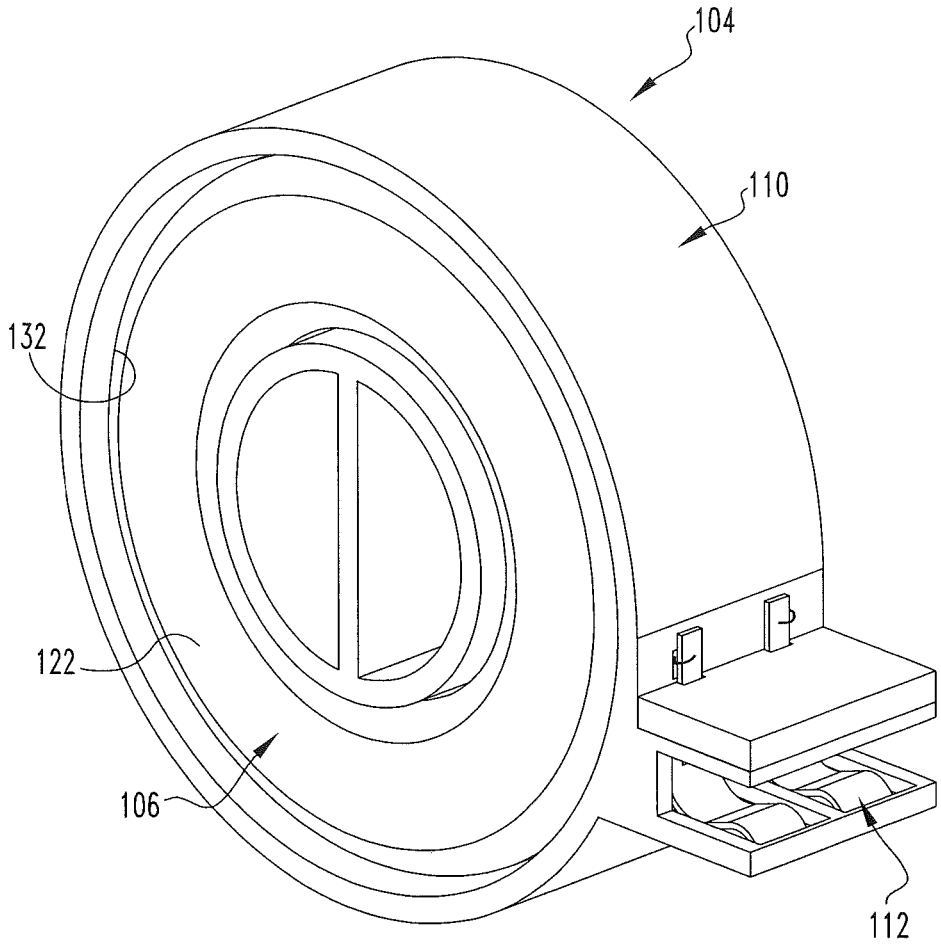
FIG. 6 is a perspective view of an improved current transformer apparatus in accordance with a second embodiment of the disclosed and claimed concept.
Figure 7:
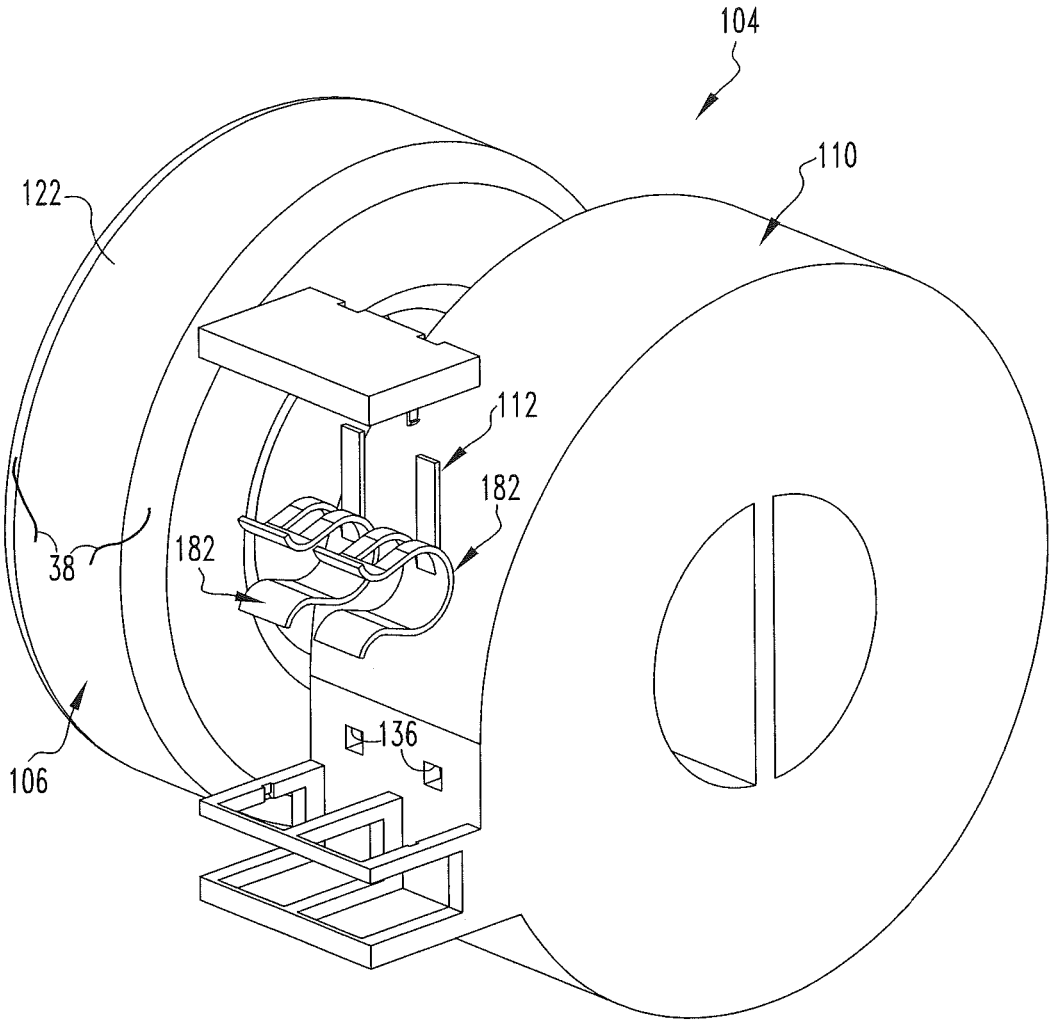
FIG. 7 is an exploded view of the current transformer apparatus of FIG. 6.

An improved current transformer apparatus 104 in accordance with a second embodiment of the disclosed and claimed concept is depicted generally in FIGS. 6 and 7. The current transformer apparatus 104 is similar to the current transformer apparatus 4 except that it includes a coil apparatus 106 that includes only a single coil 122. A support 110 of the current transformer apparatus 104 is thus configured with only a single socket 132 to receive the coil 122 therein. Likewise, a connection apparatus 112 of the current transformer apparatus 104 includes only a pair of electrical connectors 182 that are similar to the electrical connectors 82 and are electrically connected with the ends of a wire that forms the coil 122. It can be seen from FIGS. 6 and 7 that the support 110 has formed therein a pair of openings 136 that are in the form of discrete holes rather than elongated slots, but it is understood that the openings 136 could be of other configurations without departing from the spirit of the present concept.

The current transformer apparatus 104 is receivable on a circuit board in the same way in which the current transformer apparatus 4 is receivable on the circuit board 16. If desired, a pair of the current transformer apparatuses 104 can be mounted to the circuit board 16 and electrically connected with the pads 18 inasmuch as a pair of the current transformer apparatuses 104 can be substituted for and are substantially equivalent to the current transformer apparatus 4. The current transformer apparatus 104 can also be used individually.

It thus can be seen that the current transformer apparatus 104 is similar to the current transformer apparatus 4 except that is includes only a single coil 122 and is suitable for applications that require only a single coil. The current transformer apparatus 104 is also suitable for other applications in which a plurality of the current transformer apparatuses 104 can be used in conjunction with one another. Other advantages will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A current transformer apparatus that is structured to be electrically connected with and to be physically mounted to a circuit board having a plurality of pads that are electrically conductive, the current transformer apparatus comprising:

a coil apparatus comprising a wire that is wound into a coil;

a support, the coil apparatus being situated on the support, the support having formed therein a slot that is elongated and that is structured to receive therein an end of the circuit board;

a connection apparatus that is situated on the support and that comprises a plurality of electrical contacts and a number of reaction structures, the plurality of electrical contacts comprising a pair of electrical contacts situated adjacent the slot, the number of reaction structures being situated adjacent the slot, an electrical contact of the pair of electrical contacts having an electrical connection with the wire, another electrical contact of the pair of electrical contacts having another electrical connection with the wire, at least one of at least a first reaction structure of the number of reaction structures and at least one electrical contact of the pair of electrical contacts being biased generally toward the other of the at least first reaction structure and the at least one electrical contact to compressively interpose the circuit board and the plurality of pads between the at least one electrical contact and the at least first reaction structure and to simultaneously physically mount the current transformer apparatus onto the circuit board and electrically connect the connection apparatus with the plurality of pads.

2. The current transformer apparatus of claim 1 wherein the number of reaction structures comprise a plurality of reaction structures, and wherein the plurality of electrical contacts and the plurality of reaction structures together form a plurality of electrical connectors, each reaction structure of the plurality of reaction structures being situated on a corresponding electrical contact of the plurality of electrical contacts and forming with the corresponding electrical contact an electrical connector of the plurality of electrical connectors that is approximately U-shaped and which comprises a first leg that includes at least a portion of the reaction structure, a second leg that includes at least a portion of the corresponding electrical contact, and a junction where the first and second legs are connected with one another, the first and second legs being biased toward one another and structured to compressively interpose a portion of the circuit board and a corresponding pad of the plurality of pads between the first leg and the second leg and to simultaneously physically mount the current transformer apparatus onto the circuit board and electrically connect the electrical connector with the corresponding pad.

3. The current transformer apparatus of claim 2 wherein the support further comprises a base, each electrical connector being situated on the base.

4. The current transformer apparatus of claim 3 wherein the base comprises a first wall and a second wall, at least a portion of each electrical connector of the plurality of electrical connectors being retained between the first and second walls.

5. The current transformer apparatus of claim 4 wherein the base further comprises a number of dividers, and wherein at least some of the electrical connectors of the plurality of electrical connectors are arranged in a number of adjacent pairs having situated therebetween a divider of the number of dividers.

6. The current transformer apparatus of claim 5 wherein:

the base further comprises a plurality of receptacles, the plurality of electrical connectors being situated in the number of receptacles, the divider being situated between a pair of receptacles of the plurality of receptacles; and wherein the number of dividers are each formed at least in part of an electrically insulative material.

7. The current transformer apparatus of claim 4 wherein the base further comprises a number of abutments situated adjacent at least one of the first wall and the second wall and which are engageable with the plurality of electrical connectors to retain the at least portion of each electrical connector between the first and second walls.

8. The current transformer apparatus of claim 7 wherein the support further comprises a housing upon which the coil is situated, the base being situated on the housing.

9. The current transformer apparatus of claim 8 wherein the housing has a wall which at least partially surrounds the coil and on which the base is situated, the wall having formed therein at least a first passage situated adjacent the base and through which a portion of the wire extends.

10. The current transformer apparatus of claim 9 wherein each electrical connector of the plurality of electrical connectors further comprises an elongated pin that is electrically connected with the wire and that is electrically interposed between the wire and the corresponding electrical contact.

11. A combination comprising:

a circuit board comprising a first surface and a second surface opposite one another and further having a plurality of pads that are electrically conductive and that are situated on the first surface; and a current transformer apparatus that is structured to be electrically connected with and to be physically mounted to the circuit board, the current transformer apparatus comprising a coil apparatus, a support, and a connection apparatus;

the coil apparatus comprising a wire that is wound into a coil, the coil apparatus being situated on the support;

the connection apparatus being situated on the support and comprising a plurality of electrical contacts and a number of reaction structures, the plurality of electrical contacts comprising a pair of electrical contacts engageable with the first surface, the number of reaction structures engageable with the second surface, an electrical contact of the pair of electrical contacts having an electrical connection with the wire, another electrical contact of the pair of electrical contacts having another electrical connection with the wire, at least one of at least a first reaction structure of the number of reaction structures and at least one electrical contact of the pair of electrical contacts being biased generally toward the other of the at least first reaction structure and the at least one electrical contact to compressively interpose the circuit board and a corresponding pad of the plurality of pads between the at least one electrical contact and the at least first reaction structure and to simultaneously physically mount the current transformer apparatus onto the circuit board and electrically connect the connection apparatus with the plurality of pads.

12. The combination of claim 11 wherein the number of reaction structures comprise a plurality of reaction structures, and wherein the plurality of electrical contacts and the plurality of reaction structures together form a plurality of electrical connectors, each reaction structure of the plurality of reaction structures being situated on a corresponding electrical contact of the plurality of electrical contacts and forming with the corresponding electrical contact an electrical connector of the plurality of electrical connectors that is approximately U-shaped and which comprises a first leg that includes at least a portion of the reaction structure, a second leg that includes at least a portion of the corresponding electrical contact, and a junction where the first and second legs are connected with one another, the first and second legs being biased toward one another and structured to compressively interpose a portion of the circuit board and a corresponding pad of the plurality of pads between the first leg and the second leg and to simultaneously physically mount the current transformer apparatus onto the circuit board and electrically connect the electrical connector with the corresponding pad.

13. The combination of claim 12 wherein the support further comprises a base, each electrical connector being situated on the base.

14. The combination of claim 13 wherein the base comprises a first wall and a second wall, at least a portion of each electrical connector of the plurality of electrical connectors being retained between the first and second walls.

15. The combination of claim 14 wherein the base further comprises a number of dividers, and wherein at least some of the electrical connectors of the plurality of electrical connectors are arranged in a number of adjacent pairs having situated therebetween a divider of the number of dividers.

16. The combination of claim 15 wherein:

the base further comprises a plurality of receptacles, the plurality of electrical connectors being situated in the number of receptacles, the divider being situated between a pair of receptacles of the plurality of receptacles; and wherein the number of dividers are each formed at least in part of an electrically insulative material.

17. The combination of claim 14 wherein the base further comprises a number of abutments situated adjacent at least one of the first wall and the second wall and which are engageable with the plurality of electrical connectors to retain the at least portion of each electrical connector between the first and second walls.

18. The combination of claim 17 wherein the support further comprises a housing upon which the coil is situated, the base being situated on the housing.

19. The combination of claim 18 wherein the housing has a wall which at least partially surrounds the coil and on which the base is situated, the wall having formed therein at least a first passage situated adjacent the base and through which a portion of the wire extends.

20. The combination of claim 19 wherein each electrical connector of the plurality of electrical connectors further comprises an elongated pin that is electrically connected with the wire and that is electrically interposed between the wire and the corresponding electrical contact.

* * * * *